US008567763B1

(12) United States Patent
Nolan

(10) Patent No.: US 8,567,763 B1
(45) Date of Patent: Oct. 29, 2013

(54) TIRE LIFT

(76) Inventor: Enos F. Nolan, Allentown, PA (US)

( * ) Notice: Subject to any disclaimer, the term of this patent is extended or adjusted under 35 U.S.C. 154(b) by 155 days.

(21) Appl. No.: 13/065,997

(22) Filed: Apr. 5, 2011

(51) Int. Cl.
*B66F 3/22* (2006.01)
*B66F 3/00* (2006.01)

(52) U.S. Cl.
USPC ..... 254/122; 254/126

(58) Field of Classification Search
USPC ..... 254/122–126
See application file for complete search history.

(56) References Cited

U.S. PATENT DOCUMENTS 4,180,252 A * 12/1979 Cushenbery ..... 269/17
4,405,116 A * 9/1983 Eisenberg ..... 254/122
4,909,357 A * 3/1990 Kawada ..... 187/207
6,182,796 B1 * 2/2001 Perlstein et al. ..... 187/208
6,431,319 B1 * 8/2002 Myers et al. ..... 187/243

* cited by examiner

*Primary Examiner* — Monica Carter
*Assistant Examiner* — Nirvana Deonauth

(57) ABSTRACT

A tire lift is provided for lifting and supporting a tire to facilitate the task of changing tires on a vehicle. The lifting apparatus includes a base frame, an upper frame, and a lifting assembly. The lifting assembly is coupled to and extends between the base frame and the upper frame. The lifting assembly is extendable or retractable to urge the upper frame away from the base frame or draw the upper frame towards the base frame. Support rods may extend across an open top of the upper frame to support a tire in an upright position on the upper frame.

16 Claims, 3 Drawing Sheets

FIG. 2
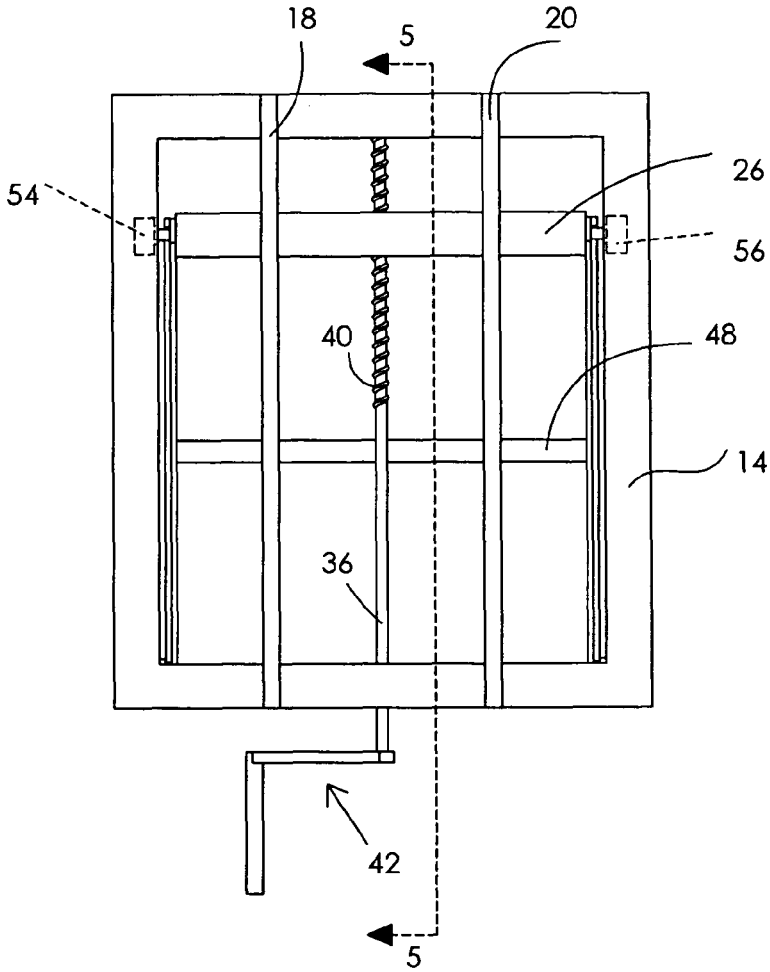
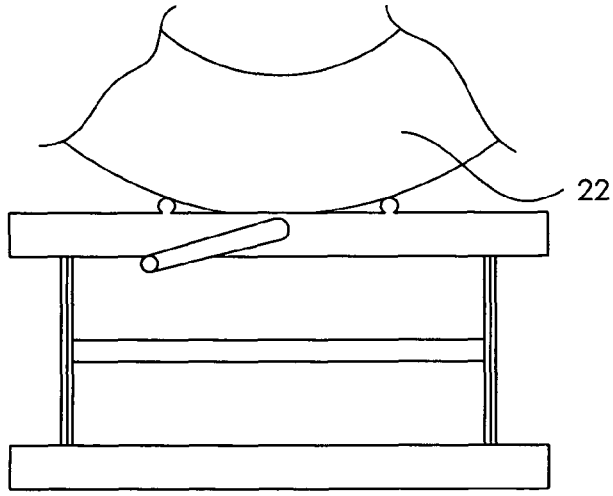
FIG. 3

TIRE LIFT

BACKGROUND OF THE DISCLOSURE

Field of the Disclosure

The disclosure relates to lifting devices and more particularly pertains to a new lifting device for lifting and supporting a tire to facilitate the task of changing tires on a vehicle.

SUMMARY OF THE DISCLOSURE

An embodiment of the disclosure meets the needs presented above by generally comprising a base frame, an upper frame, and a lifting assembly. The lifting assembly is coupled to and extends between the base frame and the upper frame. The lifting assembly is extendable or retractable to urge the upper frame away from the base frame or draw the upper frame towards the base frame. Support rods may extend across an open top of the upper frame to support a tire in an upright position on the upper frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 2 is a top view of an embodiment of the disclosure.

FIG. 3 is a front view of an embodiment of the disclosure.

DESCRIPTION OF THE PREFERRED EMBODIMENT

Figure 1:
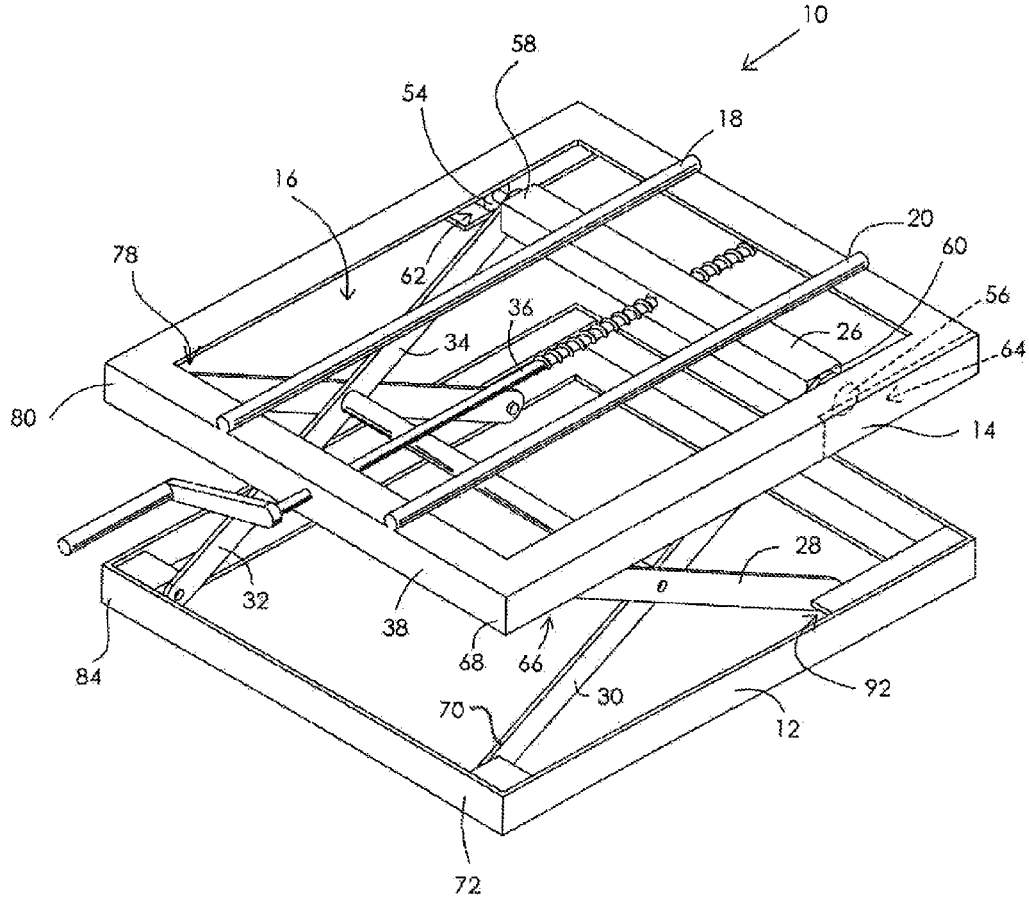
FIG. 1 is a top front side perspective view of a tire lift according to an embodiment of the disclosure.
Figure 4:
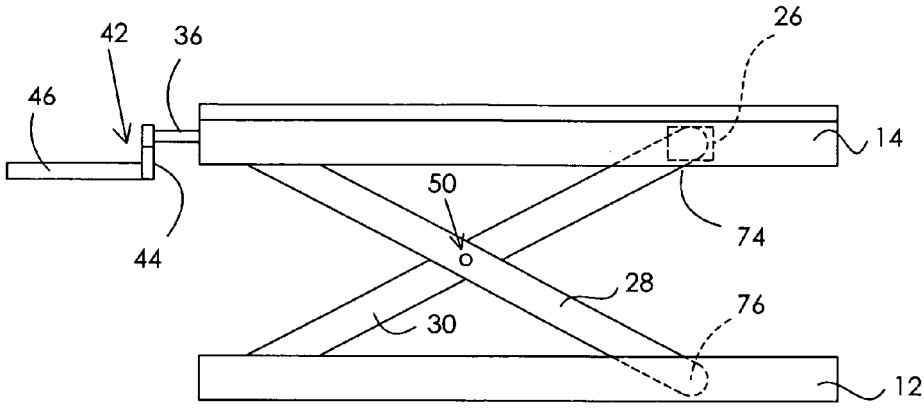
FIG. 4 is a side view of an embodiment of the disclosure.
Figure 5:
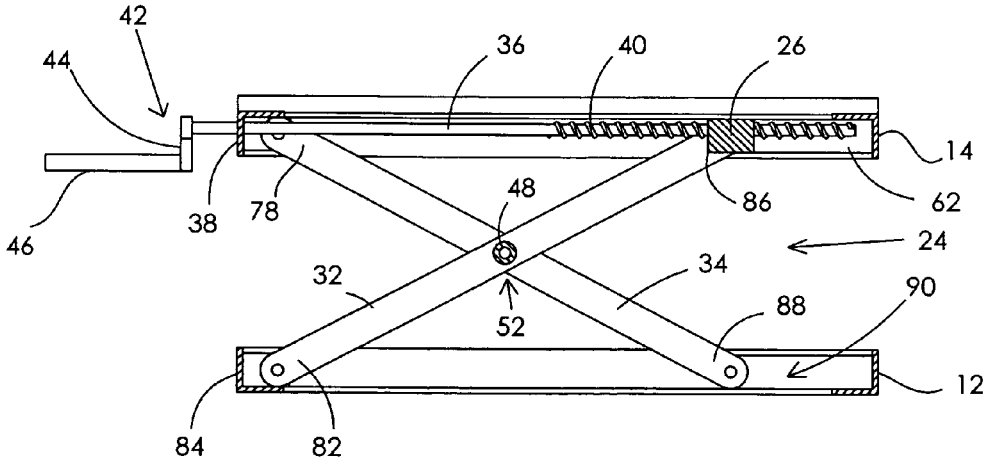
FIG. 5 is a cross-sectional view of an embodiment of the disclosure taken along line 5-5 of FIG. 3.

With reference now to the drawings, and in particular to FIGS. 1 through 5 thereof, a new lifting device embodying the principles and concepts of an embodiment of the disclosure and generally designated by the reference numeral 10 will be described.

As best illustrated in FIGS. 1 through 5, the tire lift 10 generally comprises a base frame 12, an upper frame 14 having an open top 16, and a spaced pair of rods 18,20 coupled to the upper frame 14. The rods 18,20 extend across the open top 16. Thus, the rods 18,20 are configured for stably supporting a tire 22 between the rods 18,20 when the tire 22 is in an upright position. A lifting assembly 24 is coupled to and extends between the base frame 12 and the upper frame 14. The lifting assembly 24 is extendable to urge the upper frame 14 away from the base frame 12. The lifting assembly 24 is also retractable to draw the upper frame 14 towards the base frame 12.

The lifting assembly 24 includes an actuating bar 26 slidably coupled to the upper frame 14. A pair of end rollers 54,56 are coupled to opposite ends 58,60 of the actuating bar 26. A pair of aligned spaced slots 62,64 are positioned in the upper frame 14. Each end roller 54,56 is positioned in a respective one of the slots 62,64. Thus, the actuating bar 26 is slidably coupled to the upper frame 14.

A first pair of scissor arms 28,30 and a second pair of scissor arms 32,34 are included in the lifting assembly 24. The first pair of scissor arms 28,30 and the second pair of scissor arms 32,34 are coupled to the actuating bar 26, the upper frame 14 and the base frame 12. A support member 48 is coupled to and extends between a medial pivot point 50 of the first pair of scissor arms 28,30 and a medial pivot point 52 of the second pair of scissor arms 32,34. A forward upper end 66 of the first pair of scissor arms 28,30 is pivotally coupled to a forward corner 68 of the upper frame 14. A forward lower end 70 of the first pair of scissor arms 28,30 is pivotally coupled to a forward corner 72 of the base frame 12. A rearward upper end 74 of the first pair of scissor arms 28,30 is pivotally coupled to the actuating bar 26. A rearward lower end 76 of the first pair of scissor arms 28,30 is pivotally and slidably coupled to a first slot 92 of the base frame 12.

Similarly, a forward upper end 78 of the second pair of scissor arms 32,34 is pivotally coupled to a second forward corner 80 of the upper frame 14. A forward lower end 82 of the second pair of scissor arms 32,34 is pivotally coupled to a second forward corner 84 of the base frame 12. A rearward upper end 86 of the second pair of scissor arms 32,34 is pivotally and slidably coupled to the actuating bar 26. A rearward lower end 88 of the second pair of scissor arms 32,34 is slidably and pivotally coupled to a second slot 90 in the base frame 12.

A shaft 36 is coupled to the actuating bar 26. The shaft 36 is manipulated to slide the actuating bar 26 relative to the upper frame 14. Thus, the first pair of scissor arms 28,30 and the second pair of scissor arms 32,34 act on the upper frame 14 and the base frame 12 to change a distance between the upper frame 14 and the base frame 12 lifting or lowering the upper frame 14 as desired. The shaft 36 is coupled to the upper frame 14 by passing through a forward cross-member 38 extending down from the open top 16. A threaded portion 40 of the shaft 36 extends through and engages the actuating bar 26. The actuating bar 26 is prevented from twisting relative to the upper frame 14. Thus, rotation of the shaft 36 slides the actuating bar 26 relative to the upper frame 14.

A handle 42 is coupled to the shaft 36 for facilitating rotation of the shaft 36 by hand. The handle 42 includes an offset portion 44 and an extension portion 46 extending between the offset portion 44 and the shaft 36. The offset portion 44 is coplanar with the shaft 36.

In use, the tire 22 is positioned on the upper frame 14 between the rods 18,20. The tire 22 rests on the rods 18,20 and the upper frame 14. The shaft 36 and handle 42 are positioned and oriented to extend from the upper frame 14 to facilitate cranking the shaft 36. Cranking the shaft 36 moves the actuator bar 26 causing the scissor arms 28,30,32,34 to lift or lower the tire 22 on the upper frame 14 as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A tire lifting apparatus comprising: a base frame; an upper frame; a lifting assembly coupled to and extending between said base frame and said upper frame, said lifting assembly being extendable to urge said upper frame away from said base frame, said lifting assembly being retractable to draw said upper frame towards said base frame, said lifting assembly including an actuating bar slidably coupled to said upper frame; said lifting assembly further including a first pair of scissor arms and a second pair of scissor arms, said first and second pairs of scissor arms being coupled to said actuating bar, said upper frame and said base frame; a shaft coupled to said actuating bar, said shaft being manipulatable to slide said actuating bar relative to said upper frame whereby said first pair of scissor arms and said second pair of scissor arms act on said upper frame and said base frame to change a distance between said upper frame and said base frame, said shaft being coupled to said upper frame; and a threaded portion of said shaft extending through and engaging said actuating bar such that rotation of said shaft slides said actuating bar relative to said upper frame.

2. The apparatus of claim 1, further comprising: said upper frame having an open top; and a spaced pair of rods coupled to said upper frame, said rods extending across said open top whereby said rods are configured for stably supporting a tire between said rods when the tire is in an upright position, said rods extending above a plane of an upper surface of said upper frame.

3. The apparatus of claim 1, further including a handle coupled to said shaft for facilitating rotation of said shaft.

4. The apparatus of claim 3, wherein said handle i includes an offset portion and an extension portion extending between said offset portion and said shaft, said offset portion being oriented perpendicular with said shaft.

5. The apparatus of claim 1, further including a support member coupled to and extending between a medial pivot point of said first pair of scissor arms) and a medial pivot point of said second pair of scissor arms.

6. The apparatus of claim 1, further comprising: a pair of end rollers coupled to opposite ends of said actuating bar; and a pair of aligned spaced slots positioned in said upper frame, each end roller being i positioned in a respective one of said slots whereby said actuating bar is slidably coupled to said upper frame.

7. The apparatus of claim 1, further comprising: a forward upper end of said first pair of scissor arms being pivotally coupled to said upper frame; a forward lower end of said first pair of scissor arms being pivotally coupled to said base frame; a rearward upper end of said first pair of scissor arms being pivotally coupled to said actuating bar; and a rearward lower end of said first pair of scissor arms being slidably and pivotally coupled to a first slot in said base frame.

8. The apparatus of claim 6, further comprising: a forward upper end of said second pair of scissor arms being pivotally coupled to said upper frame; a forward lower end of said second pair of scissor arms being pivotally coupled to said base frame; a rearward upper end of said second pair of scissor arms being pivotally coupled to said actuating bar; and a rearward lower end of said second pair of scissor arms being slidably and pivotally coupled to a second slot in said base frame.

9. A tire lifting apparatus comprising: a base frame; an upper frame having an open top; a spaced pair of rods coupled to said upper frame, said rods extending across said open top whereby said rods are configured for stably supporting a tire between said rods when the tire is in an upright position, said rods extending above a plane of an upper surface of said upper frame; a lifting assembly coupled to and extending between said base frame and said upper frame, said lifting assembly being extendable to urge said upper frame away from said base frame, said lifting assembly being retractable to draw said upper frame towards said base frame; an actuating bar of said lifting assembly slidably coupled to said upper frame; a first pair of scissor arms and a second pair of scissor arms, said first and second pairs of scissor arms being coupled to said actuating bar, said upper frame, and said base frame; a shaft coupled to said actuating bar, said shaft being manipulatable to slide said actuating bar relative to said upper frame whereby said first pair of scissor arms and said second pair of scissor arms act on said upper frame and said base frame to change a distance between said upper frame and said base frame, said shaft being coupled to said upper frame; a threaded portion of said shaft extending through and engaging said actuating bar such that rotation of said shaft slides said actuating bar relative to said upper frame; a handle coupled to said shaft for facilitating rotation of said shaft, wherein said handle includes an offset portion and an extension portion extending between said offset portion and said shaft; a support member coupled to and extending between a medial pivot point of said first pair of scissor arms and a medial pivot point of said second pair of scissor arms; a pair of end rollers coupled to opposite ends of said actuating bar; a pair of aligned spaced slots positioned in said upper frame, each end roller being positioned in a respective one of said slots whereby said actuating bar is slidably coupled to said upper frame; a forward upper end of said first pair of scissor arms being pivotally coupled to said upper frame; a forward lower end of said first pair of scissor arms being pivotally coupled to said base frame; a rearward upper end of said first pair of scissor arms being pivotally coupled to said actuating bar; a rearward lower end of said first pair of scissor arms being slidably and pivotally coupled to a first slot in said base frame; a forward upper end of said second pair of scissor arms being pivotally coupled to said upper frame; a forward lower end of said second pair of scissor arms being pivotally coupled to said base frame; a rearward upper end of said second pair of scissor arms being pivotally coupled to said actuating bar; and a rearward lower end of said second pair of scissor arms being slidably and pivotally coupled to a second slot in said base frame.

10. A tire lifting apparatus comprising: a base frame; an upper frame; a lifting assembly coupled to and extending between said base frame and said upper frame, said lifting assembly being extendable to urge said upper frame away from said base frame, said lifting assembly being retractable to draw said upper frame towards said base frame; said upper frame having an open top; and a spaced pair of rods coupled to said upper frame, said rods extending across said open top whereby said rods are configured for stably supporting a tire between said rods when the tire is in an upright position, said rods extending above a plane of an upper surface of said upper frame; said lifting assembly includes an actuating bar slidably coupled to said upper frame; said lifting assembly further including a first pair of scissor arms and a second pair of scissor arms. said first and second pairs of scissor arms being coupled to said actuating bar, said upper frame and said base frame; a shaft coupled to said actuating bar, said shaft being manipulatable to slide said actuating bar relative to said upper frame whereby said first pair of scissor arms and said second pair of scissor arms act on said upper frame and said base frame to change a distance between said upper frame and said base frame, said shaft extending through and being coupled to said upper frame: and a threaded portion of said shaft extending through and engaging said actuating bar such that rotation of said shaft slides said actuating bar relative to said upper frame.

11. The apparatus of claim 10 further including a handle coupled to said shaft for facilitating rotation of said shaft.

12. The apparatus of claim 10 wherein said handle includes an offset portion and an extension portion extending between said offset portion and said shaft, said offset portion being oriented perpendicular with said shaft, said extension portion being elongated along a line oriented parallel and spaced from a line extending along a length of said shaft.

13. The apparatus of claim 10 further including a support member coupled to and extending between a medial pivot point of said first pair of scissor arms and a medial pivot point of said second pair of scissor arms.

14. The apparatus of claim 10, further comprising: a pair of end rollers coupled to opposite ends of said actuating bar; and a pair of aligned spaced slots positioned in said upper frame, each end roller being positioned in a respective one of said slots whereby said actuating bar is slidably coupled to said upper frame.

15. The apparatus of claim 10, further comprising: a forward upper end of said first pair of scissor arms being pivotally coupled to said upper frame; a forward lower end of said first pair of scissor arms being pivotally coupled to said base frame; a rearward upper end of said first pair of scissor arms being pivotally coupled to said actuating bar; and a rearward lower end of said first pair of scissor arms being slidably and pivotally coupled to a first slot in said base frame.

16. The apparatus of claim 15, further comprising: a forward upper end of said second pair of scissor arms being pivotally coupled to said upper frame; a forward lower end of said second pair of scissor arms being pivotally coupled to said base frame; a rearward upper end of said second pair of scissor arms being pivotally coupled to said actuating bar; and a rearward lower end of said second pair of scissor arms being slidably and pivotally coupled to a second slot in said base frame.

* * * * *